US012613058B2

(12) United States Patent
Shi et al.

(10) Patent No.: US 12,613,058 B2
(45) Date of Patent: Apr. 28, 2026

(54) AIR CONDITIONER AND CONTROL METHOD THEREOF

(71) Applicant: QINGDAO HISENSE HITACHI AIR-CONDITIONING SYSTEMS CO., LTD., Qingdao (CN)

(72) Inventors: Lei Shi, Qingdao (CN); Xingxiang Xia, Qingdao (CN); Guilan Liu, Qingdao (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 244 days.

(21) Appl. No.: 18/405,479

(22) Filed: Jan. 5, 2024

(65) Prior Publication Data

US 2024/0133603 A1 Apr. 25, 2024
US 2024/0230191 A9 Jul. 11, 2024

Related U.S. Application Data

(63) Continuation of application No. PCT/CN2022/123639, filed on Sep. 30, 2022.

(30) Foreign Application Priority Data

Sep. 30, 2021 (CN) ..... 202111161827.7

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01); *F25B 2313/0313* (2013.01);
(Continued)

(58) Field of Classification Search
CPC ..... F25B 2313/0314; F25B 2313/0315; F25B 2500/23; F25B 2500/24; F24F 11/65
See application file for complete search history.

(56) References Cited

U.S. PATENT DOCUMENTS 8,220,280 B2 * 7/2012 Chang ..... F25B 49/005 62/149
2011/0107780 A1 * 5/2011 Yamaguchi ..... F25B 49/005 62/238.7
2020/0256573 A1 * 8/2020 Zhuo ..... F24F 11/56

FOREIGN PATENT DOCUMENTS

CN 101156033 A 4/2008
CN 101839580 A 9/2010
(Continued)

OTHER PUBLICATIONS

International Search Report and Written Opinion dated Dec. 29, 2022 in corresponding International Application No. PCT/CN2022/123639, translated, 17 pages.
(Continued)

*Primary Examiner* — Lionel Nouketcha
(74) *Attorney, Agent, or Firm* — MH2 TECHNOLOGY LAW GROUP LLP

(57) ABSTRACT

An air conditioner and a control method of an air conditioner are provided. The air conditioner includes an outdoor unit, an indoor unit, a refrigerant circulation loop, and a controller. The controller is configured to determine whether the air conditioner is operating in a cooling mode; obtain a first target supercooling degree in a first standard condition if it determined that the air conditioner is operating stably in the cooling mode; convert a supercooling degree in a current condition into a supercooling degree in the first standard condition; obtain a first refrigerant amount difference according to the first target supercooling degree, the supercooling degree in the first standard condition, an outdoor
(Continued)

unit internal volume in the first standard condition, and an outdoor unit internal volume in the current condition; and determine a refrigerant amount of the air conditioner according to the first refrigerant amount difference.

18 Claims, 4 Drawing Sheets

(52) U.S. Cl.
CPC ..... *F25B 2313/0314* (2013.01); *F25B 2313/0315* (2013.01); *F25B 2500/19* (2013.01); *F25B 2500/23* (2013.01); *F25B 2500/24* (2013.01)

(56) References Cited

FOREIGN PATENT DOCUMENTS

| | | | |
|---|---|---|---|
| CN | 203231423 | U | 10/2013 |
| CN | 104676944 | A | 6/2015 |
| CN | 105864984 | A | 8/2016 |
| CN | 107101323 | A | 8/2017 |
| CN | 107906672 | A | 4/2018 |
| CN | 110068103 | A | 7/2019 |
| CN | 110529966 | A | 12/2019 |
| CN | 110906506 | A | 3/2020 |
| CN | 111520868 | A | 8/2020 |
| CN | 113739348 | A | 12/2021 |
| CN | 113865029 | A | 12/2021 |
| JP | 2005098691 | A | 4/2005 |
| JP | 2018132217 | A | 8/2018 |
| KR | 20140010704 | A | 1/2014 |
| WO | 2019065635 | A1 | 4/2019 |
| WO | 2021184615 | A1 | 9/2021 |

OTHER PUBLICATIONS

Chinese First Office Action dated Jul. 29, 2022 in corresponding Chinese Application No. 202111161827.7, translated, 13 pages.
Chinese Notification to Grant Patent Right for Invention dated Oct. 28, 2022 in corresponding Chinese Application No. 202111161827.7, translated, 9 pages.

* cited by examiner

AIR CONDITIONER AND CONTROL METHOD THEREOF

CROSS-REFERENCE TO RELATED APPLICATIONS

This application is a continuation application of International Patent Application No. PCT/CN2022/123639, filed on Sep. 30, 2022, pending, which claims priority to Chinese Patent Application No. 202111161827.7, filed on Sep. 30, 2021, which are incorporated herein by reference in their entireties.

TECHNICAL FIELD

The present disclosure relates to the field of air conditioning technologies, and in particular, to an air conditioner and a control method of the air conditioner.

BACKGROUND

A multi-split air conditioner includes an outdoor unit, a refrigerant circulation loop, a controller, and at least one indoor unit. The at least one indoor unit is connected to the outdoor unit through the refrigerant circulation loop. The controller is coupled to the outdoor unit, the refrigerant circulation loop, and the at least one indoor unit, so as to adjust a temperature of at least one indoor space where the at least one indoor unit is located.

SUMMARY

In an aspect, an air conditioner is provided. The air conditioner includes: an outdoor unit, at least one indoor unit, a refrigerant circulation loop, and a controller. The outdoor unit is connected to the at least one indoor unit through the refrigerant circulation loop. The controller is configured to perform at least one of: determining whether the air conditioner is operating in one of a cooling mode and a heating mode according to an outdoor ambient temperature, a return air temperature of the indoor unit and an operating state of the indoor unit; performing a first refrigerant amount determining mode if it is determined that the air conditioner is operating in the cooling mode, and the air conditioner is operating stably in the cooling mode, the performing the first refrigerant amount determining mode including: obtaining a first target supercooling degree in a first standard condition; converting a supercooling degree in a current condition into a supercooling degree in the first standard condition; obtaining a first refrigerant amount difference according to a first corresponding relationship among the first target supercooling degree, the supercooling degree in the first standard condition, an outdoor unit internal volume in the first standard condition, an outdoor unit internal volume in the current condition, and the first refrigerant amount difference, the first refrigerant amount difference being a first relative refrigerant amount calculated based on the first standard condition in the cooling mode; determining a refrigerant amount of the air conditioner according to the first refrigerant amount difference; or, performing a second refrigerant amount determining mode if it is determined that the air conditioner is operating in the heating mode, and the air conditioner is operating stably in the heating mode, the performing the second refrigerant amount determining mode including: obtaining a second target supercooling degree in a second standard condition; converting a supercooling degree in the current condition into a supercooling degree in the second standard condition; obtaining a second refrigerant amount difference according to a second corresponding relationship among the second target supercooling degree, the supercooling degree in the second standard condition, an indoor unit internal volume in the second standard condition, an indoor unit internal volume in the current condition, and the second refrigerant amount difference, the second refrigerant amount difference being a second relative refrigerant amount calculated based on the second standard condition in the heating mode; and determining the refrigerant amount of the air conditioner according to the second refrigerant amount difference.

In another aspect, a control method of an air conditioner is provided. The air conditioner includes: an outdoor unit, at least one indoor unit, a refrigerant circulation loop, and a controller. The outdoor unit is connected to the at least one indoor unit through the refrigerant circulation loop. The controller is coupled to the outdoor unit, the indoor unit, and the refrigerant circulation loop. The method includes at least one of: determining whether the air conditioner is operating in one of a cooling mode and a heating mode according to an outdoor ambient temperature, a return air temperature of the indoor unit and an operating state of the indoor unit; performing a first refrigerant amount determining mode if it is determined that the air conditioner is operating in the cooling mode, and the air conditioner is operating stably in the cooling mode, the performing the first refrigerant amount determining mode including: obtaining a first target supercooling degree in a first standard condition; calculating a first target refrigerant amount according to the first target supercooling degree, the first target refrigerant amount being greater than or equal to 0; converting a supercooling degree in a current condition into a supercooling degree in the first standard condition according to the supercooling degree in the current condition and a first supercooling degree correction value; calculating a refrigerant amount corresponding to the supercooling degree in the first standard condition according to the supercooling degree in the first standard condition, the refrigerant amount corresponding to the supercooling degree in the first standard condition being greater than or equal to 0; calculating a first refrigerant amount difference according to the refrigerant amount corresponding to the supercooling degree in the first standard condition, the first target refrigerant amount, an outdoor unit internal volume in the current condition, and an outdoor unit internal volume in the first standard condition; determining a refrigerant amount of the air conditioner according to the first refrigerant amount difference; or, performing a second refrigerant amount determining mode if it is determined that the air conditioner is operating in the heating mode, and that the air conditioner is operating stably in the heating mode, the performing the second refrigerant amount determining mode including: obtaining a second target supercooling degree in a second standard condition; calculating a second target refrigerant amount according to the second target supercooling degree, the second target refrigerant amount being greater than or equal to 0; converting a supercooling degree in a current condition into a supercooling degree in the second standard condition according to the supercooling degree in the current condition and a second supercooling degree correction value; calculating a refrigerant amount corresponding to the supercooling degree in the second standard condition according to the supercooling degree in the second standard condition, the refrigerant amount corresponding to the supercooling degree in the second standard condition being greater than or equal to 0; calculating a second refrigerant amount difference according to the refrigerant amount corresponding to the supercooling degree in the second standard condition, the second target refrigerant amount, an indoor unit internal volume in the current condition, and an indoor unit internal volume in the second standard condition; and determining the refrigerant amount of the air conditioner according to the second refrigerant amount difference.

DETAILED DESCRIPTION

Figure 1:
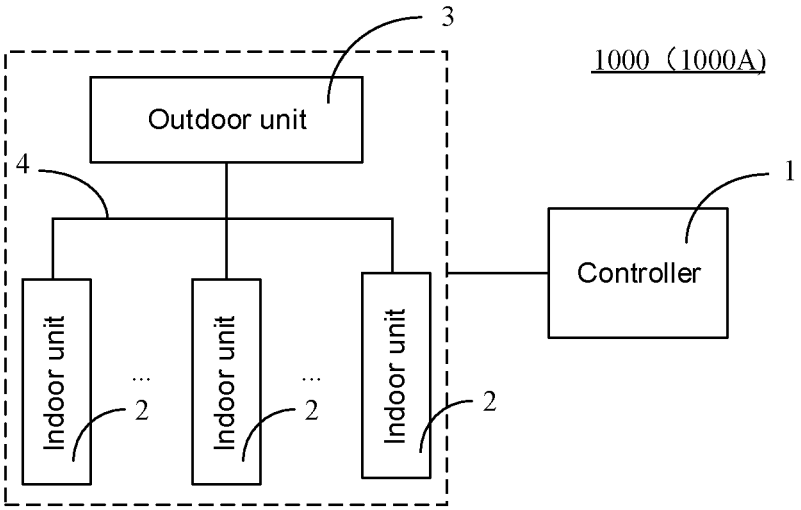
FIG. 1 is a schematic diagram of a multi-split air conditioner, in accordance with some embodiments.

Some embodiments of the present disclosure will be clearly and completely described below with reference to the accompanying drawings. However, the described embodiments are merely some but not all embodiments of the present disclosure. All other embodiments obtained by a person of ordinary skill in the art based on embodiments of the present disclosure shall be included in the protection scope of the present disclosure.

Unless the context requires otherwise, throughout the specification and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment," "some embodiments," "exemplary embodiments," "example," "specific example," or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Hereinafter, the terms such as "first" and "second" are used for descriptive purposes only and are not to be construed as indicating or implying the relative importance or implicitly indicating the number of indicated technical features. Thus, features defined by "first" or "second" may explicitly or implicitly include one or more of the features. In the description of the embodiments of the present disclosure, the term "a plurality of" or "the plurality of" means two or more unless otherwise specified.

In the description of some embodiments, the expressions "coupled," "connected," and derivatives thereof may be used. The term "connected" should be understood in a broad sense. For example, the term "connected" may represent a fixed connection, a detachable connection, or a one-piece connection, or may represent a direct connection, or may represent an indirect connection through an intermediate medium. The term "coupled" indicates that two or more components are in direct physical or electrical contact with each other. The term "coupled" or "communicatively coupled" may also mean that two or more components are not in direct contact with each other but still cooperate or interact with each other. The embodiments disclosed herein are not necessarily limited to the content herein.

The phrase "at least one of A, B, and C" has the same meaning as the phrase "at least one of A, B, or C," both including the following combinations of A, B, and C: only A, only B, only C, a combination of A and B, a combination of A and C, a combination of B and C, and a combination of A, B, and C.

As used herein, the term "if" is, optionally, construed as "when" or "in a case where" or "in response to determining that" or "in response to detecting," depending on the context. Similarly, depending on the context, the phrase "if it is determined that" or "if [a stated condition or event] is detected" is optionally construed as "in a case where it is determined that" or "in response to determining that" or "in a case where [the stated condition or event] is detected" or "in response to detecting [the stated condition or event]."

The use of the phrase "applicable to" or "configured to" herein means an open and inclusive expression, which does not exclude devices that are applicable to or configured to perform additional tasks or steps.

In addition, the use of the phase "based on" is meant to be open and inclusive, since a process, step, calculation, or other action that is "based on" one or more of the stated conditions or values may, in practice, be based on additional conditions or value beyond those stated.

Any value within a range as used herein may be two endpoints, or any value within the range. For example, a preset duration is any value within a range of A min to B min, and the preset duration may be A min, C min, or B min ($A<C<B$).

Figure 2:
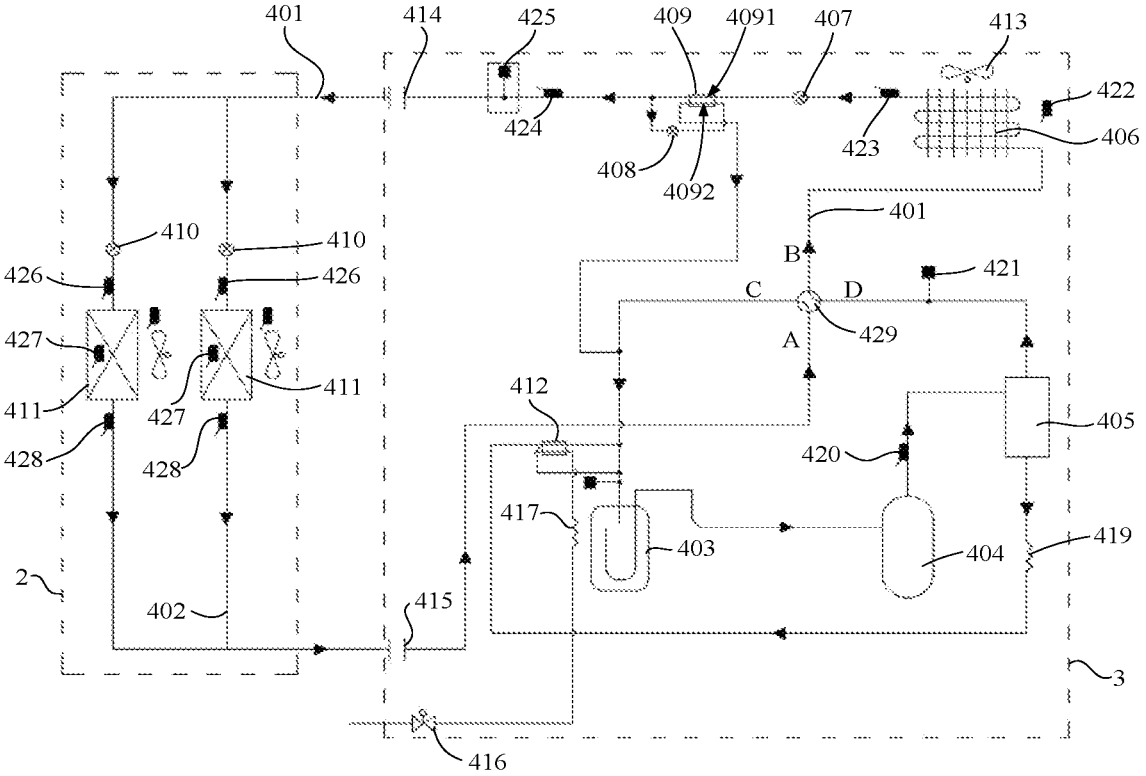
FIG. 2 is a schematic diagram of a refrigerant circulation loop, in accordance with some embodiments.

Referring to FIGS. 1 and 2, a structure and an operating principle of an air conditioner 1000A will be mainly described by considering a multi-split air conditioner 1000 as an example.

In some embodiments, referring to FIG. 1, the air conditioner 1000A includes an outdoor unit 3, a controller 1, a refrigerant circulation loop (also referred to as a refrigerant pipe) 4, and at least one indoor unit 2, and the refrigerant circulation loop 4 is configured to connect the outdoor unit 3 and the at least one indoor unit 2. The refrigerant flows through the refrigerant circulation loop 4, so that the compression, condensation, throttling, and evaporation of the refrigerant may be achieved. The controller 1 is coupled to the outdoor unit 3, the refrigerant circulation loop 4, and the at least one indoor unit 2.

In some embodiments, referring to FIG. 2, the air conditioner 1000A further includes a compressor 404 coupled to the compressor 404.

In some embodiments, the multi-split air conditioner 1000 includes a liquid pipe 401, a gas pipe 402, a gas-liquid separator 403, a compressor 404, an oil separator 405, an outdoor heat exchanger 406, a first expansion valve 407, an outdoor fan 413, a second expansion valve 408, a plurality of third expansion valves 410, and a plurality of indoor heat exchangers 411 that form the refrigerant circulation loop 4. The first expansion valve 407 is located in the outdoor unit 3. The plurality of third expansion valves 410 are located in the indoor unit 2, and the plurality of third expansion valves 410 and the plurality of indoor heat exchanger 411 are correspondingly arranged, respectively. The outdoor fan 413 is disposed adjacent to the outdoor heat exchanger 406. For example, the outdoor fan 413 is disposed on a top portion or a front portion of the outdoor heat exchanger 406. Here, the first expansion valve 407, the second expansion valve 408, and the third expansion valve 410 may be an electronic expansion valve.

In some embodiments, the air conditioner 1000A further includes a four-way valve 429, a subcooler 409, a regenerator 412, a first stop valve 414, a second stop valve 415, a solenoid valve 416, a first pressure reducer 417, a second pressure reducer 419, a first temperature sensor 420, a second temperature sensor 422, a third temperature sensor 423, a fourth temperature sensor 424, a fifth temperature sensor 426, a sixth temperature sensor 427, a seventh temperature sensor 428, a first pressure sensor 421, and a second pressure sensor 425.

The first temperature sensor 420 is configured to detect an exhaust temperature of the compressor 404. The second temperature sensor 422 is disposed at an air inlet end of the outdoor heat exchanger 406 and is configured to detect an outdoor ambient temperature. The third temperature sensor 423 is configured to detect a temperature of the liquid pipe 401 at a refrigerant outlet end of the outdoor heat exchanger 406. The fourth temperature sensor 424 is configured to detect a temperature of the liquid pipe 401 at the first stop valve 414. The fifth temperature sensor 426 is configured to detect a temperature of the liquid pipe 401 at a refrigerant inlet end of the indoor heat exchanger 411. The sixth temperature sensor 427 is disposed at a center of the indoor heat exchanger 411, and there is a gas-liquid two-phase refrigerant in the center of the indoor heat exchanger 411. The sixth temperature sensor 427 is configured to detect a saturation temperature of the gas-liquid two-phase refrigerant. The seventh temperature sensor 428 is configured to detect a temperature of the gas pipe 402 at a refrigerant outlet end of the indoor heat exchanger 411. The first pressure sensor 421 is configured to detect an exhaust pressure of the compressor 404, and the first pressure sensor 421 is farther away from an exhaust port of the compressor 404 than the first temperature sensor 420. The second pressure sensor 425 is configured to detect a pressure of the first stop valve 414, and the second pressure sensor 425 is farther away from the first stop valve 414 than the fourth temperature sensor 424.

The four-way valve 429 has four ports A, B, C, and D, and the four ports A, B, C, and D are connected to the second stop valve 415, the outdoor heat exchanger 406, the gas-liquid separator 403, and an outlet of the oil separator 405, respectively, so as to control the flow direction of the refrigerant by controlling the connectivity state of the four ports. Thus, the air conditioner 1000A may switch between the cooling mode and the heating mode.

The operating principle of the air conditioner 1000A is described with reference to FIG. 2, and the arrow direction shown in FIG. 2 represents a flow direction of the refrigerant.

The gaseous refrigerant with high temperature and high pressure compressed and discharged by the compressor 404 flows into the outdoor heat exchanger 406 through the oil separator 405. The outdoor heat exchanger 406 condenses the gaseous refrigerant with high temperature and high pressure into supercooled liquid refrigerant with high temperature and high pressure. Meanwhile, heat is released into the surrounding environment through the condensation process.

A first portion of the supercooled liquid refrigerant with high temperature and high pressure is throttled into supercooled liquid refrigerant or two-phase refrigerant with medium pressure or low pressure through the first expansion valve 407 and the second expansion valve 408, and then flows into an auxiliary path 4092 of the subcooler 409 for superheating, so as to obtain superheated refrigerant with low temperature and low pressure. A second portion of the supercooled liquid refrigerant with high temperature and high pressure flows into a main path 4091 of the subcooler 409 through the first expansion valve 407 for further supercooling, and then flows into the third expansion valve 410 through the first stop valve 414.

The third expansion valve 410 throttles supercooled refrigerant with high temperature and high pressure into two-phase refrigerant with low temperature and low pressure. The two-phase refrigerant with low temperature and low pressure evaporates into superheated refrigerant with low temperature and low pressure in the indoor heat exchanger 411. The superheated refrigerant with low temperature and low pressure passes through the second stop valve 415 and combines with the superheated refrigerant with low temperature and low pressure flowing out from the auxiliary path 4092 of the subcooler 409, and the combined refrigerant flows into the compressor 404 through the gas-liquid separator 403, so that the cooling cycle is completed.

In the related art, the installation or maintenance people of the air conditioner usually perform a refrigerant filling operation on the air conditioner based on experience. Due to lack of reliable feedback on the filling result of the refrigerant amount, after the refrigerant filling is completed, the refrigerant amount of the air conditioner often appears excessive or insufficient. In addition, inadequate installation or long-term use of the air conditioner may also cause refrigerant leakage, resulting in insufficient refrigerant amount of the air conditioner.

In a case where the refrigerant amount of the air conditioner is excessive, it may cause the air conditioner to shut down for protection due to over high pressure, so that the air conditioner cannot operate normally; and in a case where the refrigerant amount of the air conditioner is insufficient, it may cause a decrease in the cooling capacity and the operating efficiency of the air conditioner and may also cause the air conditioner to shut down for protection due to over high exhaust temperature or over low pressure, so that the air conditioner cannot operate normally. Therefore, determining the refrigerant amount of the air conditioner is of great significance for ensuring the normal operation of the air conditioner.

In the related art, the refrigerant amount of the air conditioner is preliminarily determined according to parameters such as the exhaust temperature of the compressor or the superheat degree of the exhaust gas of the compressor, the pressure of the air conditioner system, and the superheat degree of the return gas of the compressor.

For example, that the refrigerant amount of the air conditioner is preliminarily determined according to the exhaust temperature of the compressor or the superheat degree of the exhaust gas of the compressor includes: if it is determined that the exhaust temperature of the compressor or the superheat degree of the exhaust gas of the compressor is greater than a preset value, it is determined that the refrigerant amount is insufficient in the air conditioner.

However, generally, the air conditioner further includes a throttle valve. In a case where the compressor of the air conditioner is worn or the throttle valve is blocked, even if the refrigerant amount of the air conditioner is normal, the exhaust temperature of the compressor or the superheat degree of the exhaust gas of the compressor will also increase. Therefore, using the above determining method, it is impossible to distinguish whether the abnormal refrigerant amount is related to the wear of the compressor and the blockage of the throttle valve, which may easily cause misjudgment of the refrigerant amount of the air conditioner.

In addition, in a case where the refrigerant amount of the air conditioner is preliminarily determined according to the exhaust temperature of the compressor or the superheat degree of the exhaust gas of the compressor, even if the components in the air conditioner operate normally, when the exhaust temperature of the compressor or the superheat degree of the exhaust gas of the compressor is greater than the preset value, generally, the refrigerant amount of the air conditioner has been severely insufficient. Therefore, the determining method has low accuracy and reliability.

In response to the above technical problems in the related art, after research, the following may be found.

In the cooling mode, the indoor heat exchanger 411 is used as an evaporator, and the refrigerant inside the indoor heat exchanger 411 has two forms of gas-liquid two-phase and gaseous; the outdoor heat exchanger 406 is used as a condenser, and the refrigerant inside the outdoor heat exchanger 406 has three forms of liquid, gas-liquid two-phase, and gaseous.

In the heating mode, the indoor heat exchanger 411 is used as a condenser, and the refrigerant inside the indoor heat exchanger 411 has three forms of liquid, gas-liquid two-phase, and gaseous; the outdoor heat exchanger 406 is used as an evaporator, and the refrigerant inside the outdoor heat exchanger 406 has two forms of gas-liquid two-phase and gaseous.

It may be seen that, the distribution of the refrigerant amount of the air conditioner 1000A in a case where the air conditioner 1000A operates in the heating mode is different from that in a case where the air conditioner 1000A operates in the cooling mode.

Since the supercooling degree is related to the distribution of the refrigerant amount, in some embodiments of the present disclosure, the refrigerant amount is represented by the supercooling degree. In this way, by determining whether the air conditioner 1000A operates in the heating mode or the cooling mode, and determining the refrigerant amount in a case where the air conditioner 1000A is operating in one of the heating mode and the cooling mode, it is conducive to improving the accuracy of determining the refrigerant amount.

The air conditioner 1000A in some embodiments of the present disclosure uses the supercooling degree to represent the refrigerant amount and performs different calculations for the cooling mode and the heating mode. In the cooling mode, the refrigerant amount is represented by the supercooling degree of the outdoor unit 3; in the heating mode, the refrigerant amount is represented by the supercooling degree of the indoor unit 2.

The air conditioner 1000A in some embodiments of the present disclosure uses a standard condition as a benchmark and satisfies at least one of the following. In a case where the air conditioner 1000A is operating in the cooling mode, a supercooling degree $SCz_c$ in a current condition is converted into a supercooling degree $SCs_c$ in the standard condition, and a first relative refrigerant amount of the air conditioner 1000A is calculated based on the standard condition, and the refrigerant amount of the air conditioner 1000A is determined according to the first relative refrigerant amount; or, in a case where the air conditioner 1000A is operating in the heating mode, a supercooling degree $SCz_h$ in the current condition is converted into a supercooling degree $SCs_h$ in the standard condition, and a second relative refrigerant amount of the air conditioner 1000A is calculated based on the standard condition, and the refrigerant amount of the air conditioner 1000A is determined according to the second relative refrigerant amount. The determining method of the air conditioner 1000A may avoid the influence of different connection schemes and operating environments on the determination of the refrigerant amount, which is conducive to improving the accuracy and reliability in determining of the refrigerant amount and obtaining information on the current refrigerant amount of the air conditioner 1000A in a timely manner, so as to replenish the refrigerant or remove the refrigerant in a timely manner, thereby avoiding the adverse effects on the operation of the air conditioner 1000A due to excessive or insufficient refrigerant, and ensuring the normal operation of the air conditioner 1000A. It will be noted that, the standard conditions corresponding to the cooling mode and the heating mode are different from each other. For ease of description, hereinafter, the standard condition corresponding to the cooling mode is referred to as a first standard condition, and the standard condition corresponding to the heating mode is referred to as a second standard condition.

Based on the above technical concept, some embodiments of the present disclosure provide an air conditioner 1000A. The air conditioner 1000A has a refrigerant amount determining mode in addition to operating modes such as a heating mode, a cooling mode, and a defrosting mode. Before performing the determination of the refrigerant amount, the air conditioner 1000A needs to have the refrigerant amount determining mode turned on.

The air conditioner 1000A further includes a controller 1, and the controller 1 is configured to: in a case where the refrigerant amount determining mode is turned on, determine whether the air conditioner 1000A is operating in the cooling mode according to an outdoor ambient temperature, a return air temperature of the indoor unit 2, and an operating state of the indoor unit 2; if it is determined that the air conditioner 1000A is operating in the cooling mode, determine whether the air conditioner 1000A is operating stably in the cooling mode; and if it is determined that the air conditioner 1000A is operating stably in the cooling mode, perform a first refrigerant amount determining mode. Performing the first refrigerant amount determining mode includes: obtaining a first target supercooling degree $SCo_c$ in the standard condition; converting a supercooling degree $SCz_c$ in the current condition into a supercooling degree $SCs_c$ in the standard condition; obtaining a first refrigerant amount difference ΔMC according to a first corresponding relationship among the first target supercooling degree $SCo_c$ in the standard condition, the supercooling degree $SCs_c$ in the standard condition, an outdoor unit internal volume Vos in the standard condition, an outdoor unit internal volume Vo in the current condition, and the first refrigerant amount difference ΔMC; the first refrigerant amount difference ΔMC is a first relative refrigerant amount calculated based on the standard condition in the cooling mode; and determining the refrigerant amount of the air conditioner 1000A according to the first refrigerant amount difference ΔMC.

In a case where the refrigerant amount determining mode is turned on, the controller 1 is configured to: determine whether the air conditioner 1000A is operating in the heating mode according to the outdoor ambient temperature, the return air temperature of the indoor unit 2, and the operating state of the indoor unit 2; if it is determined that the air conditioner 1000A is operating in the heating mode, determine whether the air conditioner 1000A is operating stably in the heating mode; and if it is determined that the air conditioner 1000A is operating stably in the heating mode, perform a second refrigerant amount determining mode. Performing the second refrigerant amount determining mode includes: obtaining a second target supercooling degree $SCo_h$ in the standard condition; converting a supercooling degree $SCz_h$ in the current condition into a supercooling degree $SCs_h$ in the standard condition; obtaining a second refrigerant amount difference ΔMH according to a second corresponding relationship among the second target supercooling degree $SCo_h$ in the standard condition, the supercooling degree $SCs_h$ in the standard condition, an indoor unit internal volume Vis in the standard condition, an indoor unit internal volume Vi in the current condition, and the second refrigerant amount difference ΔMH; the second refrigerant amount difference ΔMH is a second relative refrigerant amount calculated based on the standard condition in the heating mode; and determining the refrigerant amount of the air conditioner 1000A according to the second refrigerant amount difference ΔMH.

The controller 1 includes a processor. The processor may include a central processing unit (CPU), a microprocessor, or an application specific integrated circuit (ASIC), and the processor may be configured to execute the corresponding operations described in the controller 1 when the processor executes a program stored in a non-transitory computer-readable media coupled to the controller 1.

It will be noted that, the indoor unit internal volume may be a volume of a pipeline used for refrigerant flow in the indoor heat exchanger or a volume of a pipeline used for refrigerant flow in the indoor unit. In a case where the air conditioner includes a plurality of indoor units, the indoor unit internal volume may refer to a sum of the indoor unit internal volumes of the plurality of indoor units. The outdoor unit internal volume may be a volume of a pipeline used for refrigerant flow in the outdoor heat exchanger or a volume of a pipeline used for refrigerant flow in the outdoor unit. In a case where the air conditioner includes a plurality of outdoor units, the outdoor unit internal volume may refer to a sum of the outdoor unit internal volumes of the plurality of outdoor units.

In some embodiments of the present disclosure, the method to turn on or turn off the refrigerant amount determining mode of the air conditioner 1000A includes but is not limited to: adding a selection box of the refrigerant amount determining mode in operating state selection boxes of the air conditioner 1000A, and achieving operations such as selecting, turning on, or turning off the refrigerant amount determining mode by pressing a button; or setting a selection button or a switch button for controlling the refrigerant amount determining mode, and coupling the selection button or the switch button to the controller 1.

The standard condition may be a condition set during experimental testing. In the standard condition, by controlling the related parameters (e.g., an opening degree of the third expansion valve 410, or a motor frequency of the outdoor fan 413) of the air conditioner 1000A, it is possible to control a distribution state of the refrigerant in the evaporator to be constant. A change of the distribution state of the refrigerant in the evaporator may be determined according to the superheat degree of the refrigerant in the evaporator. In this case, it is possible to improve the accuracy of the first refrigerant amount difference ΔMC and the second refrigerant amount difference ΔMH calculated according to the standard condition.

The air conditioner 1000A uses the standard condition as the benchmark and calculates the first relative refrigerant amount of the air conditioner 1000A in the cooling mode and the second relative refrigerant amount of the air conditioner 1000A in the heating mode. In the cooling mode, the first refrigerant amount difference ΔMC is calculated according to the first corresponding relationship among the first target supercooling degree $SCo_c$ in the standard condition, the supercooling degree $SCs_c$ in the standard condition, the outdoor unit internal volume Vos in the standard condition, the outdoor unit internal volume Vo in the current condition, and the first refrigerant amount difference ΔMC, so as to determine the refrigerant amount in the current condition. In the heating mode, the second refrigerant amount difference ΔMH is calculated according to the second corresponding relationship among the second target supercooling degree $SCo_h$ in the standard condition, the supercooling degree $SCs_h$ in the standard condition, the indoor unit internal volume Vis in the standard condition, the indoor unit internal volume Vi in the current condition, and the second refrigerant amount difference ΔMH, so as to determine the refrigerant amount in the current condition. Based on the above settings of the air conditioner 1000A, it is conducive to obtaining information on the current refrigerant amount of the air conditioner 1000A in a timely manner, which facilitates maintenance of the air conditioner 1000A and normal operation of the air conditioner 1000A.

The process of determining the refrigerant amount of the air conditioner 1000A performed by the controller 1 in some embodiments of the present disclosure will be mainly described below with reference to the accompanying drawings.

In some embodiments of the present disclosure, the controller 1 is configured to determine an operating state and a corresponding operating mode (including the cooling mode and the heating mode) of the air conditioner 1000A according to the outdoor ambient temperature, the return air temperature of the indoor unit 2, and the operating state of the indoor unit 2.

It will be noted that the outdoor ambient temperature and the return air temperature of the indoor unit 2 may be collected by temperature sensors at corresponding positions. The outdoor ambient temperature refers to the currently collected outdoor ambient temperature. The return air temperature of the indoor unit 2 refers to the currently collected return air temperature of the indoor unit 2. The operating state of the indoor unit 2 includes a current operating state or a shutdown state.

In some embodiments, the outdoor ambient temperature is collected by the second temperature sensor 422.

In some embodiments, the controller 1 is configured to determine whether the air conditioner 1000A is operating in the cooling mode according to the outdoor ambient temperature, the return air temperature of the indoor unit 2, and the operating state of the indoor unit 2.

For example, in a case where the outdoor ambient temperature is within a first preset range, the return air temperatures of all indoor units 2 are within a second preset range, and all indoor units 2 are in a shutdown state, the controller 1 determines that the air conditioner 1000A is operating in the cooling mode. For example, the first preset range is any value within a range of −10° C. to 43° C. (i.e., [−10° C., 43° C.]), and the second preset range is any value within a range of 10° C. to 35° C.] (i.e., [10° C., 35° C.]).

In some embodiments, the controller 1 is configured to determine whether the air conditioner 1000A is operating in the heating mode according to the outdoor ambient temperature, the return air temperature of the indoor unit 2, and the operating state of the indoor unit 2.

For example, in a case where the outdoor ambient temperature is within a third preset range, the return air temperatures of all indoor units 2 are within a fourth preset range, and all indoor units 2 are in a shutdown state, the controller 1 determines that the air conditioner 1000A is operating in the heating mode.

For example, the third preset range is any value within a range of −20° C. to −10° C. (i.e., [−20° C., −10° C.]), and the fourth preset range is any value within a range of 0° C. to 25° C. (i.e., [0° C., 25° C.]).

It will be noted that, the air conditioner usually starts from the shutdown state when the air conditioner switches the operating modes. Therefore, before the air conditioner 1000A operates in the cooling or heating mode, the indoor unit 2 is required to be in the shutdown state.

In some embodiments, the controller 1 is configured to determine whether the air conditioner 1000A is operating stably in the cooling mode if it is determined that the air conditioner 1000A is operating in the cooling mode.

An example is given below to describe how to determine that the air conditioner 1000A is operating stably in the cooling mode. After the air conditioner 1000A operates in the cooling mode for a preset duration, the exhaust temperature of the compressor 404 is periodically collected. In a case where a difference between two adjacent exhaust temperatures collected is within a first preset temperature range, a first superheat degree of the indoor unit 2 is greater than a first preset value and lasts for a first period T1, and a second superheat degree of the indoor unit 2 is less than a second preset value and lasts for a second period T2, it is determined that the air conditioner 1000A is operating stably in the cooling mode.

For example, the preset duration may be any value within a range of 10 min to 20 min. The exhaust temperature of the compressor 404 may be collected by the first temperature sensor 420.

In a case where the at least one indoor unit 2 includes a plurality of indoor units 2, the first superheat degree of the indoor unit 2 represents the minimum value among the superheat degrees of the plurality of indoor units 2. The second superheat degree of the indoor unit 2 represents the maximum value among the superheat degrees of the plurality of indoor units 2.

For example, the first preset temperature range includes but is not limited to a range of 2° C. to 4° C. The first preset value includes but is not limited to 2° C., and the second preset value includes but is not limited to 8° C. The first period T1 may be any value within a range of 2 min to 5 min, and the second period T2 may be any value within a range of 2 min to 5 min.

In some embodiments, the controller 1 is configured to determine whether the air conditioner 1000A is operating stably in the heating mode if it is determined that the air conditioner 1000A is operating in the heating mode.

An example is given below to describe how to determine that the air conditioner 1000A is operating stably in the heating mode. After the air conditioner 1000A operates in the heating mode for a preset duration, the exhaust temperature of the compressor 404 is periodically collected. In a case where a difference between two adjacent exhaust temperatures collected is within a second preset temperature range, it is determined that the air conditioner 1000A is operating stably in the heating mode.

For example, the second preset temperature range includes but is not limited to a range of 2° C. to 4° C.

The method for obtaining the superheat degree of the indoor unit 2 includes but is not limited to: obtaining the superheat degree of the indoor unit 2 by subtracting an inlet temperature of the indoor heat exchanger 411 from an outlet temperature of the indoor heat exchanger 411.

In some embodiments, the controller 1 is configured to perform the first refrigerant amount determining mode if it is determined that the air conditioner 1000A is operating stably in the cooling mode.

In some embodiments, the controller 1 is configured to perform the second refrigerant amount determining mode if it is determined that the air conditioner 1000A is operating stably in the heating mode.

In some embodiments, if it is determined that the air conditioner 1000A is operating unstably in the cooling mode, the controller 1 is configured to repeat the step of determining whether the air conditioner 1000A is operating stably in the cooling mode until the air conditioner 1000A is operating stably, and then perform the first refrigerant amount determining mode.

Similarly, if it is determined that the air conditioner 1000A is operating unstably in the heating mode, the controller 1 is configured to repeat the step of determining whether the air conditioner 1000A is operating stably in the heating mode until the air conditioner 1000A is operating stably, and then perform the second refrigerant amount determining mode.

In some embodiments of the present disclosure, during a process of performing one of the first refrigerant amount determining mode and the second refrigerant amount determining mode, the controller 1 determines the refrigerant amount of the air conditioner 1000A by calculating a difference between the refrigerant amount in the current condition and a target refrigerant amount in the current condition.

It will be noted that, the condition includes a connection scheme and parameters such as an outdoor ambient temperature, an indoor dry bulb temperature, and an indoor wet bulb temperature. The connection scheme mainly refers to a connection manner between the outdoor unit 3 and the indoor unit 2. For example, one outdoor unit 3 is connected to three indoor units 2.

The target refrigerant amount represents a refrigerant amount required for the air conditioner 1000A to reach a target operating state in the current condition. The target operating state is an operating state in which at least one of the cooling capacity or the heating capacity of the air conditioner 1000A reaches a preset range.

In the cooling mode, it is required that a standard condition I (i.e., the first standard condition) is set before the controller 1 performs the first refrigerant amount determining mode.

In some embodiments, the standard condition I includes: the connection scheme being that one outdoor unit 3 is connected to three indoor units 2, the outdoor ambient temperature being 35° C., the indoor dry bulb temperature being 27° C., and the indoor wet bulb temperature being 19° C.

According to the corresponding relationship between the refrigerant amount and the supercooling degree, the greater the supercooling degree, the greater the refrigerant amount. In the standard condition I, the corresponding relationship between the subcooling degree S and refrigerant amount M may be obtained through testing (e.g., formula (1)).

$$M=RCa\times S^2+RCb\times S+RCc \quad (1)$$

Where RCa, RCb, and RCc each are constants, and the refrigerant amount M is greater than or equal to 0 (i.e., $M\geq 0$). For example, values of RCa, RCb, and RCc satisfy that RCa is any value within an open interval with a lower limit of −1 and an upper limit of 0, RCb is any value within a closed interval with a lower limit of 1 and an upper limit of 5, and RCc is any value within a closed interval with a lower limit of 5 and an upper limit of 20 (i.e., RCa∈(−1, 0), RCb∈[1, 5], RCc∈[5, 20]).

As mentioned above, in the cooling mode, the supercooling degree of the air conditioner 1000A may be represented by the supercooling degree of the outdoor unit 3. The supercooling degree of the outdoor unit 3 may be calculated according to the exhaust pressure of the compressor 404 detected by the first pressure sensor 421 and the temperature detected by the third temperature sensor 423.

For example, the controller 1 obtains a refrigerant saturation temperature corresponding to the exhaust pressure detected by the first pressure sensor 421 according to the corresponding relationship between the exhaust pressure of the compressor 404 and a refrigerant saturation temperature, and then calculates a difference between the refrigerant saturation temperature and the temperature detected by the third temperature sensor 423, so as to obtain the supercooling degree of the outdoor unit 3 as the supercooling degree of the air conditioner 1000A.

An example is given below to describe how the controller 1 performs the first refrigerant amount determining mode.

In some embodiments, performing the first refrigerant amount determining mode includes: in the standard condition (e.g., the standard condition I), obtaining a supercooling degree corresponding to the constant distribution state of the refrigerant in the evaporator, and using the supercooling degree as the first target supercooling degree $SCo_c$, obtaining a first target refrigerant amount MCo corresponding to the first target supercooling degree $SCo_c$, converting the supercooling degree $SCz_c$ in the current condition into the supercooling degree $SCs_c$ in the standard condition; calculating a refrigerant amount MCs corresponding to the supercooling degree $SCs_c$ in the standard condition; calculating the first refrigerant amount difference ΔMC in the current condition; and determining the refrigerant amount of the air conditioner 1000A according to the first refrigerant amount difference ΔMC.

The first target supercooling degree $SCo_c$ is a preset value or a preset range of the supercooling degree obtained in the standard condition I. The first target supercooling degree $SCo_c$ may be obtained by looking up a table including a corresponding relationship between the supercooling degree and a ratio of the indoor unit internal volume and the outdoor unit internal volume. There is a rule between the supercooling degree and the ratio of the indoor unit internal volume and the outdoor unit internal volume. In the cooling mode, the greater the ratio of the indoor unit internal volume and the outdoor unit internal volume, the greater the first target supercooling degree $SCo_c$.

The method for obtaining the first target refrigerant amount MCo includes: substituting the first target supercooling degree $SCo_c$ into the formula (1) to obtain the first target refrigerant amount MCo.

$$MCo=RCa\times SCo_c^2+RCb\times SCo_c+RCc$$

In some embodiments, the current condition includes: the connection scheme being that two outdoor units 3 are connected to three indoor units 2, the outdoor ambient temperature being 37° C., the indoor dry bulb temperature being 24° C., and the indoor wet bulb temperature being 15° C.

In some embodiments, the supercooling degree $SCz_c$ in the current condition is represented by the supercooling degree of the liquid pipe 401 of the outdoor unit 3.

It will be noted that, the supercooling degree $SCz_c$ of the liquid pipe 401 of the outdoor unit 3 may be represented by a supercooling degree of the liquid pipe 401 of the outdoor unit 3 calculated at a certain moment. Alternatively, the supercooling degree $SCz_c$ of the liquid pipe 401 of the outdoor unit 3 may also be represented by an average supercooling degree $SCz_c'$ of the liquid pipe 401 of the outdoor unit 3. Alternatively, the supercooling degree $SCz_c$ of the liquid pipe 401 of the outdoor unit 3 may also be represented by an average $SCz_c''$ of the supercooling degrees of the outdoor units 3. In a case where the average supercooling degree $SCz_c'$ of the liquid pipe 401 of the outdoor unit 3 or the average $SCz_c''$ of the supercooling degrees of the outdoor units 3 is used to calculate the supercooling degree $SCz_c$, the result of the supercooling degree may be more accurate.

In some embodiments, the average $SCz_c''$ of the supercooling degrees of the outdoor units 3 may be calculated according to a formula (2). In a case where the average $SCz_c''$ of the supercooling degrees of the outdoor units 3 is used to represent the supercooling degree $SCz_c$, the supercooling degree $SCz_c$ of the liquid pipe 401 of the outdoor unit 3 is equal to the average $SCz_c''$ of the supercooling degrees of the outdoor units 3 (i.e., $SCz_c=SCz_c''$).

$$SCz_c''=\frac{\sum_{i-1}^{n}(T_c-Tl(i))}{n} \tag{2}$$

Where $T_c$ is a refrigerant saturation temperature corresponding to a maximum value of the exhaust pressure of the compressor 404; Tl(i) represents a temperature of the liquid pipe 401 of the i-th outdoor unit 3, which may be collected by the third temperature sensor 423; and n represents the number of the outdoor unit 3.

In some embodiments, the average supercooling degree $SCz_c'$ of the liquid pipe 401 of the outdoor unit 3 may be calculated according to a formula (3). In a case where the average supercooling degree $SCz_c'$ of the liquid pipe 401 of the outdoor unit 3 is used to represent the supercooling degree $SCz_c$, the supercooling degree $SCz_c$ of the liquid pipe 401 of the outdoor unit 3 is equal to the average supercooling degree $SCz_c'$ of the liquid pipe 401 of the outdoor unit 3 (i.e., $SCz_c=SCz_c'$).

$$SCz_c'=T_c-Te_{ave} \tag{3}$$

Where $Te_{ave}$ is an average temperature of the liquid pipe 401 of the outdoor unit 3.

According to a formula (4), the supercooling degree $SCz_c$ in the current condition is converted into the supercooling degree $SCs_c$ in the standard condition.

$$SCs_c=SCz_c-SCo1_c \tag{4}$$

Where $SCo1_c$ is a first supercooling degree correction value, and the first supercooling degree correction value $SCo1_c$ is related to the indoor ambient temperature and the outdoor ambient temperature, and there is a definite relationship between the first supercooling degree correction value $SCo1_c$ and at least one of the indoor ambient temperature or the outdoor ambient temperature. The indoor ambient temperature may be represented by an average $Ti_{ave}$ of the return air temperatures of the indoor unit 2. The first supercooling degree correction value $SCo1_c$ may be any value within a range of 10° C. to 10° C. (i.e., the threshold range).

For example, different first supercooling degree correction values $SCo1_c$ are obtained according to different outdoor ambient temperatures Ta and different indoor ambient temperatures.

In a case where the outdoor ambient temperature Ta is greater than or equal to 35° C. (i.e., Ta≥35° C.), $SCo1_c=a\times(Ta-35)$.

In a case where the outdoor ambient temperature Ta is greater than or equal to 22° C. and less than 35° C. (i.e., 22° C.≤Ta<35° C.), $SCo1_c=3-b\times(Ta-20)$.

In a case where the outdoor ambient temperature Ta is greater than or equal to 10° C. and less than 22° C. (i.e., 10° C.≤Ta<22° C.), $SCo1_c=c$.

In a case where the outdoor ambient temperature Ta is less than 10° C. (i.e., Ta<10° C.), $SCo1_c=3-d\times(20-Ti_{ave})$.

Where the a, b, and d each are any value within an open interval with a lower limit of 0 and an upper limit of 1 (i.e., (0, 1)); c is equal to 3 (i.e., c=3); and $Ti_{ave}$ is an average of the return air temperatures of the indoor unit 2.

In some embodiments, the supercooling degree $SCs_c$ in the standard condition is substituted into the formula (1) to obtain the refrigerant amount MCs corresponding to the supercooling degree $SCs_c$ in the standard condition.

$$MCs=RCa\times SCs_c^2+RCb\times SCs_c+RCc$$

Where RCa, RCb, and RCc are constants and the refrigerant amount MCs corresponding to the supercooling degree $SCs_c$ in the standard condition is greater than or equal to 0 (i.e., MCs≥0).

In some embodiments, the controller 1 is configured to obtain the first refrigerant amount difference ΔMC in the current condition according to the third refrigerant amount difference ΔMC' in the standard condition I.

The obtained first target refrigerant amount MCo and the refrigerant amount MCs corresponding to the supercooling degree $SCs_c$ in the standard condition are substituted into a formula (5) to calculate the third refrigerant amount difference ΔMC' in the standard condition I.

$$\Delta MC'=MCs-MCo \quad (5)$$

In some embodiments, the first refrigerant amount difference ΔMC in the current condition is calculated according to a proportional relationship between the first refrigerant amount difference ΔMC in the current condition and the outdoor unit internal volume. That is to say, the controller 1 obtains the first refrigerant amount difference ΔMC in the current condition according to a formula (6).

$$\Delta MC=(MCs-MCo)\times Vo/Vos \quad (6)$$

Where Vo is the outdoor unit internal volume in the current condition, and Vos is the outdoor unit internal volume in the standard condition I.

In this way, the first refrigerant amount difference ΔMC in the current condition calculated according to the standard condition I may be obtained.

Since the first refrigerant amount difference ΔMC in the current condition is calculated based on the standard condition I, the connection scheme and the operating environment of the air conditioner 1000A have little effect on the calculation result of the refrigerant amount, thereby improving the accuracy in determining the refrigerant amount.

In a case where the first refrigerant amount difference ΔMC in the current condition is greater than 0, the refrigerant amount is greater than the target refrigerant amount corresponding to the constant distribution state of the refrigerant in the current condition. For example, if the first refrigerant amount difference ΔMC is equal to 3.3 Kg (i.e., ΔMC=3.3 Kg), the refrigerant amount of the air conditioner 1000A in the current cooling mode is 3.3 Kg more than the target refrigerant amount.

In a case where the first refrigerant amount difference ΔMC in the current condition is less than 0, the refrigerant amount is less than the target refrigerant amount corresponding to the constant distribution state of the refrigerant in the current condition. For example, if the first refrigerant amount difference ΔMC in the current condition is equal to −2 Kg (i.e., ΔMC=−2 Kg), the refrigerant amount of the air conditioner 1000A in the current cooling mode is 2 Kg less than the target refrigerant amount.

In some embodiments, the controller 1 is further configured to output prompt information of abnormal refrigerant amount in a case where the first refrigerant amount difference ΔMC is outside a first preset refrigerant amount range.

It can be understood that the prompt information of abnormal refrigerant amount may provide a reference for the user or the installation and maintenance people of the air conditioner 1000A, thereby providing convenience for the installation and maintenance people of the air conditioner 1000A to troubleshoot related faults of the refrigerant.

In some embodiments, the prompt information of abnormal refrigerant amount includes but is not limited to an indicating code. For example, if the indicating code is H1, it means that in the current cooling mode, the refrigerant amount of the air conditioner 1000A is 2 Kg less than the first target refrigerant amount MCo, which indicates that 2 Kg of refrigerant needs to be added. If the indicating code is H2, it means that in the current cooling mode, the refrigerant amount of the air conditioner 1000A is 4 Kg less than the first target refrigerant amount MCo, which indicates that 4 Kg of refrigerant needs to be added.

In some embodiments, outputting the prompt information of abnormal refrigerant amount includes but is not limited to outputting by means of an indicator lamp.

For example, if it is determined that the refrigerant amount is too much, the indicator lamp is green. Alternatively, if it is determined that the refrigerant amount is too little, the indicator lamp is red.

In the heating mode, it is required that a standard condition II (i.e., the second standard condition) is set before the controller 1 performs the second refrigerant amount determining mode.

In some embodiments, the standard condition II includes: the connection scheme being that one outdoor unit 3 is connected to three indoor units 2, the outdoor ambient temperature being 15° C., the indoor dry bulb temperature being 20° C., and the indoor wet bulb temperature being 14° C.

According to the corresponding relationship between the refrigerant amount and the supercooling degree, the greater the supercooling degree, the greater the refrigerant amount. In the standard condition II, the corresponding relationship between the supercooling degree S and the refrigerant amount M may be tested and obtained as the following formula (7).

$$M=-RCd\times S^2+RCe\times S+RCf \quad (7)$$

Where RCd, RCe, and RCf each are constants, and the refrigerant amount M is greater than or equal to 0 (i.e., M≥0). For example, values of RCd, RCe, and RCf satisfy that RCd is any value within an open interval with a lower limit of −1 and an upper limit of 0, RCe is any value within a closed interval with a lower limit of 0.1 and an upper limit of 1.5, and RCf is any value within a closed interval with a lower limit of 5 and an upper limit of 15 (i.e., RCd∈(−1, 0), RCe∈[0.1, 1.5], RCf∈[5, 15]).

As mentioned above, in the heating mode, the supercooling degree of the air conditioner 1000A may be represented by the supercooling degree of the indoor unit 2. The supercooling degree of the indoor unit 2 may be calculated according to a difference between a refrigerant saturation temperature detected by the sixth temperature sensor 427 and a temperature detected by the fifth temperature sensor 426.

An example is given below to describe how the controller 1 performs the second refrigerant amount determining mode.

In some embodiments, performing the second refrigerant amount determining mode includes: in the standard condition (e.g., the standard condition II), obtaining the supercooling degree corresponding to the constant distribution state of the refrigerant in the evaporator, and using the supercooling degree as the second target supercooling degree $SCo_h$; obtaining a second target refrigerant amount MHo corresponding to the second target supercooling degree $SCo_h$; converting the supercooling degree $SCz_h$ in the current condition into the supercooling degree $SCs_h$ in the standard condition (e.g., the standard condition II); calculating the refrigerant amount MHs corresponding to the supercooling degree $SCs_h$ in the standard condition; calculating the second refrigerant amount difference ΔMH in the current condition; and determining the refrigerant amount of the air conditioner 1000A according to the second refrigerant amount difference ΔMH.

The second target supercooling degree $SCo_h$ is a preset value or a preset range of the supercooling degree obtained in the standard condition II. In the heating mode, the greater the ratio between the indoor unit internal volume and the outdoor unit internal volume, the less the second target supercooling degree $SCo_h$.

The method for obtaining the second target refrigerant amount MHo includes: substituting the second target supercooling degree $SCo_h$ into the formula (7) to obtain the second target refrigerant amount MHo.

$$MHo=-RCd\times SCo_h^2+RCe\times SCo_h+RCf$$

In some embodiments, the current condition includes: the connection scheme being that two outdoor units 3 are connected to three indoor units 2, the outdoor ambient temperature being 13° C., the indoor dry bulb temperature being 22° C., and the indoor wet bulb temperature being 13° C.

In some embodiments, the supercooling degree $SCz_h$ in the current condition is represented by the supercooling degree of the liquid pipe 401 of the indoor unit 2.

It will be noted that the supercooling degree $SCz_h$ of the liquid pipe 401 of the indoor unit 2 may be represented by a supercooling degree of the liquid pipe 401 of the indoor unit 2 calculated at a certain moment. Alternatively, the supercooling degree $SCz_h$ of the liquid pipe 401 of the indoor unit 2 may also be represented by an average supercooling degree $SCz_h'$ of the liquid pipe 401 of the indoor unit 2. Alternatively, the supercooling degree $SCz_h$ of the liquid pipe 401 of the indoor unit 2 may also be represented by an average $SCz_h''$ of the supercooling degrees of the indoor units 2. In a case where the average supercooling degree $SCz_h'$ of the liquid pipe 401 of the indoor unit 2 or the average $SCz_h''$ of the supercooling degrees of the indoor units 2 is used to calculate the supercooling degree $SCz_h$, the result of the supercooling degree may be more accurate.

In some embodiments, the average supercooling degree $SCz_h'$ of the liquid pipe 401 of the indoor unit 2 may be calculated according to a formula (8). In a case where the average supercooling degree $SCz_h'$ of the liquid pipe 401 of the indoor unit 2 is used to represent the supercooling degree $SCz_h$, the supercooling degree $SCz_h$ of the liquid pipe 401 of the indoor unit 2 is equal to the average supercooling degree $SCz_h'$ of the liquid pipe 401 of the indoor unit 2 (i.e., $SCz_h=SCz_h'$).

$$SCz_h'=T_c-Ti_{ave} \tag{8}$$

Where $T_c$ is a refrigerant saturation temperature corresponding to a maximum value of the exhaust pressure of the compressor 404, and $Ti_{ave}$ is an average temperature of the liquid pipe 401 of the indoor unit 2, which may be detected by the fifth temperature sensor 426.

In some embodiments, the average $SCz_h''$ of the supercooling degrees of the indoor units 2 may be calculated according to a formula (9). In a case where the average $SCz_h''$ of the supercooling degrees of the indoor units 2 is used to represent the supercooling degree $SCz_h$, the supercooling degree $SCz_h$ of the liquid pipe 401 of the indoor unit 2 is equal to the average $SCz_h''$ of the supercooling degrees of the indoor units 2 (i.e., $SCz_h=SCz_h''$).

$$SCz_h''=\frac{\sum_{i-1}^{n}(T_c-Th(i))}{n} \tag{9}$$

Where Th(i) represents a temperature of the liquid pipe 401 of the i-th indoor unit 2, which may be detected by the fifth temperature sensor 426; n represents the number of the indoor unit 2.

According to a formula (10), the supercooling degree $SCz_h$ in the current condition is converted into the supercooling degree $SCs_h$ in the standard condition.

$$SCs_h=SCz_h-SCo1_h \tag{10}$$

Where $SCo1_h$ is a second supercooling degree correction value, and the second supercooling degree correction value $SCo1_h$ is related to at least one of the indoor ambient temperature or the outdoor ambient temperature Ta, and there is a definite relationship between the second supercooling degree correction value $SCo1_h$ and at least one of the indoor ambient temperature or the outdoor ambient temperature Ta. The second supercooling degree correction value $SCo1_h$ may be any value within a range of −10° C. to 10° C.

For example, the second supercooling degree correction value $SCo1_h$ has the following relationship with the outdoor ambient temperature Ta and the indoor ambient temperature, referring to a formula (11).

$$SCoI_h=RHa+RHb\times Ta+RHc+Ti_{ave} \tag{11}$$

Where RHa, RHb, and RHc each are constants, and $Ti_{ave}$ is the average of the return air temperatures of the indoor unit 2. For example, RHa (i.e., the first constant) is any value within an open interval with a lower limit of 2 and an upper limit of 5 (i.e., (2, 5)); RHb (i.e., the second constant) is any value within an open interval with a lower limit of 0.1 and an upper limit of 0.5 (i.e., (0.1, 0.5)); and RHc (i.e., the third constant) is any value within an open interval with a lower limit of −1 and an upper limit of 0 (i.e., (−1, 0)).

In some embodiments, the supercooling degree $SCs_h$ in the standard condition is substituted into the formula (7) to obtain the refrigerant amount MHs corresponding to the supercooling degree $SCs_h$ in the standard condition.

$$MHs=-RCd\times SCs_h^2+RCe\times SCs_h+RCf$$

Where RCd, RCe, and RCf are constants and the refrigerant amount MHs corresponding to the supercooling degree $SCs_h$ in the standard condition is greater than or equal to 0 (i.e., MHs≥0).

In some embodiments, the controller 1 is configured to obtain the second refrigerant amount difference ΔMH in the current condition according to a fourth refrigerant amount difference ΔMH' in the standard condition II.

The obtained second target refrigerant amount MHo and the refrigerant amount MHs corresponding to the supercooling degree $SCs_h$ in the standard condition are substituted into a formula (12) to calculate the fourth refrigerant amount difference ΔMH' in the standard condition II.

$$\Delta MH'=MHs-MHo \quad (12)$$

In some embodiments, the second refrigerant amount difference ΔMH in the current condition is calculated according to a proportional relationship between the second refrigerant amount difference ΔMH in the current condition and the indoor unit internal volume. That is to say, the second refrigerant amount difference ΔMH in the current condition is obtained according to a formula (13).

$$\Delta MH=(MHs-MHo)\times Vi/Vis \quad (13)$$

Where Vi is the indoor unit internal volume in the current condition, and Vis is the indoor unit internal volume in the standard condition II.

In this way, the second refrigerant amount difference ΔMH in the current condition may be obtained and calculated according to the standard condition II.

Since the second refrigerant amount difference ΔMH in the current condition is calculated according to the standard condition II, the connection scheme and the operating environment of the air conditioner 1000A have little effect on the calculation result of the refrigerant amount, thereby improving the accuracy in determining the refrigerant amount.

In a case where the second refrigerant amount difference ΔMH in the current condition is greater than 0, the refrigerant amount is greater than the target refrigerant amount corresponding to the constant distribution state of the refrigerant in the current condition.

For example, if the second refrigerant amount difference ΔMH in the current condition is equal to 3.3 Kg (i.e., ΔMH=3.3 Kg), the refrigerant amount of the air conditioner 1000A in the current heating mode is 3.3 Kg more than the target refrigerant amount.

In a case where the second refrigerant amount difference ΔMH in the current condition is less than 0, the refrigerant amount is less than the target refrigerant amount corresponding to the constant distribution state of the refrigerant in the current condition. For example, if the second refrigerant amount difference ΔMH in the current condition is equal to −2 Kg (i.e., ΔMH=−2 Kg), the refrigerant amount of the air conditioner 1000A in the current heating mode is 2 Kg less than the target refrigerant amount.

In some embodiments, the controller 1 is further configured to output prompt information of abnormal refrigerant amount in a case where the second refrigerant amount difference ΔMH is outside a second preset refrigerant amount range.

It can be understood that the prompt information of abnormal refrigerant amount may provide a reference for the user or the installation and maintenance people of the air conditioner 1000A, thereby providing convenience for the installation and maintenance people of the air conditioner 1000A to troubleshoot related faults of the refrigerant.

In some embodiments, the prompt information of abnormal refrigerant amount includes but is not limited to an indicating code. For example, if the indicating code is L1, it means that in the current heating mode, the refrigerant amount of the air conditioner 1000A is 2 Kg more than the second target refrigerant amount MHo. If the indicating code is L2, it means that in the current heating mode, the refrigerant amount of the air conditioner 1000A is 4 Kg more than the second target refrigerant amount MHo.

In some embodiments, outputting the prompt information of abnormal refrigerant amount includes but is not limited to outputting by means of an indicator lamp. For example, if it is determined that the refrigerant amount is too much, the indicator lamp is green. Alternatively, if it is determined that the refrigerant amount is too little, the indicator lamp is red.

The air conditioner in some embodiments of the present disclosure may determine the refrigerant amount in at least one of the cooling mode or the heating mode, which solves the problem that the air conditioner in the related art cannot operate in the heating mode in a case where the outdoor ambient temperature is low, causing failed refrigerant amount determination.

Moreover, the air conditioner 1000A provided in some embodiments of the present disclosure may determine the refrigerant amount of the air conditioner 1000A by calculating the relative refrigerant amount of the air conditioner 1000A in at least one of the cooling mode or the heating mode, so as to avoid affecting the reliability of the air conditioner 1000A due to excessive or insufficient refrigerant amount.

In addition, the determination of the refrigerant amount of the air conditioner 1000A in some embodiments of the present disclosure is that the refrigerant amount in the current condition is determined according to the relative refrigerant amount in the standard condition I or the standard condition II. Therefore, the connection scheme and the operating environment of the air conditioner 1000A have little effect on the accuracy in determining the refrigerant amount, thereby improving the accuracy in determining the refrigerant amount.

Moreover, the obtained determination result of the refrigerant amount may provide indicating information such as whether the refrigerant amount in the current condition is excessive or insufficient, and the adjustment amount of the refrigerant, which provides convenience for the installation and maintenance people to troubleshoot failure.

Figure 3:
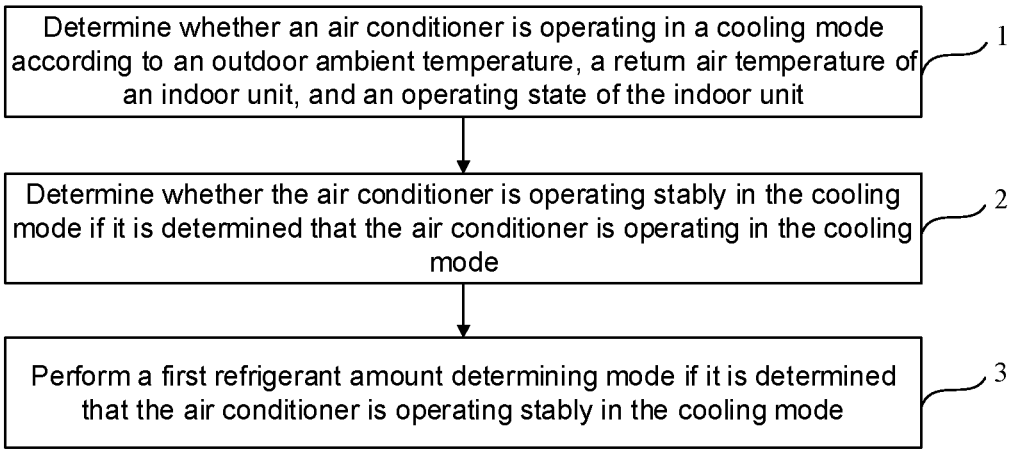
FIG. 3 is a flow chart of a control method of an air conditioner, in accordance with some embodiments.
Figure 4:
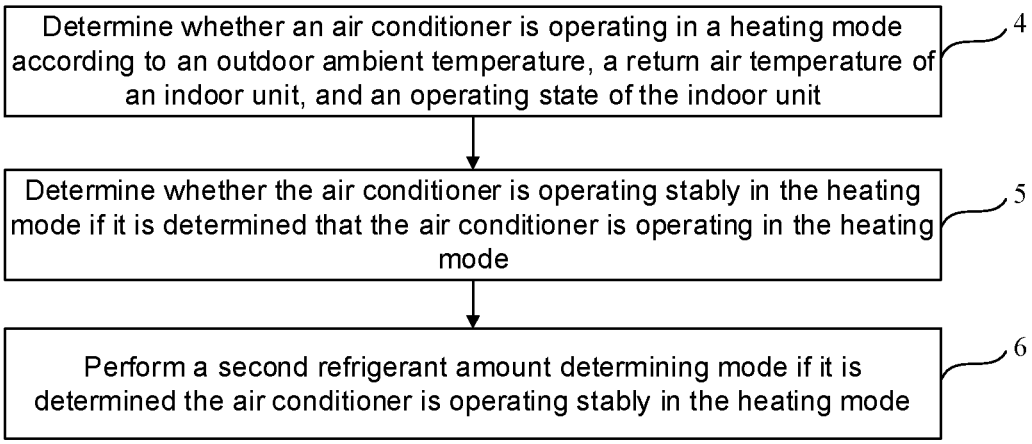
FIG. 4 is another flow chart of a control method of an air conditioner, in accordance with some embodiments.

Some embodiments of the present disclosure further provide a control method of an air conditioner. The air conditioner is similar to the air conditioner 1000A described above. Referring to FIGS. 3 and 4, the method includes at least one of step 1 to step 3 or step 4 to step 6. It will be noted that, for the execution process of the steps in the method, reference may be made to the relevant descriptions of the above steps performed by the controller 1, and the beneficial effects of the method include at least the beneficial effects of the air conditioner 1000A in the aforementioned embodiments, and details will not be repeated herein.

In step 1, whether the air conditioner is operating in a cooling mode is determined according to an outdoor ambient temperature, a return air temperature of an indoor unit, and an operating state of the indoor unit.

In step 2, whether the air conditioner is operating stably in the cooling mode is determined if it is determined that the air conditioner is operating in the cooling mode.

In step 3, a first refrigerant amount determining mode is performed if it is determined that the air conditioner is operating stably in the cooling mode.

In step 4, whether the air conditioner is operating in a heating mode is determined according to the outdoor ambient temperature, the return air temperature of the indoor unit, and the operating state of the indoor unit.

In step 5, whether the air conditioner is operating stably in the heating mode is determined if it is determined that the air conditioner is operating in the heating mode.

In step 6, a second refrigerant amount determining mode is performed if it is determined that the air conditioner is operating stably in the heating mode.

It will be noted that the step 1 may be performed before the step 4 or after the step 6.

Figure 5:
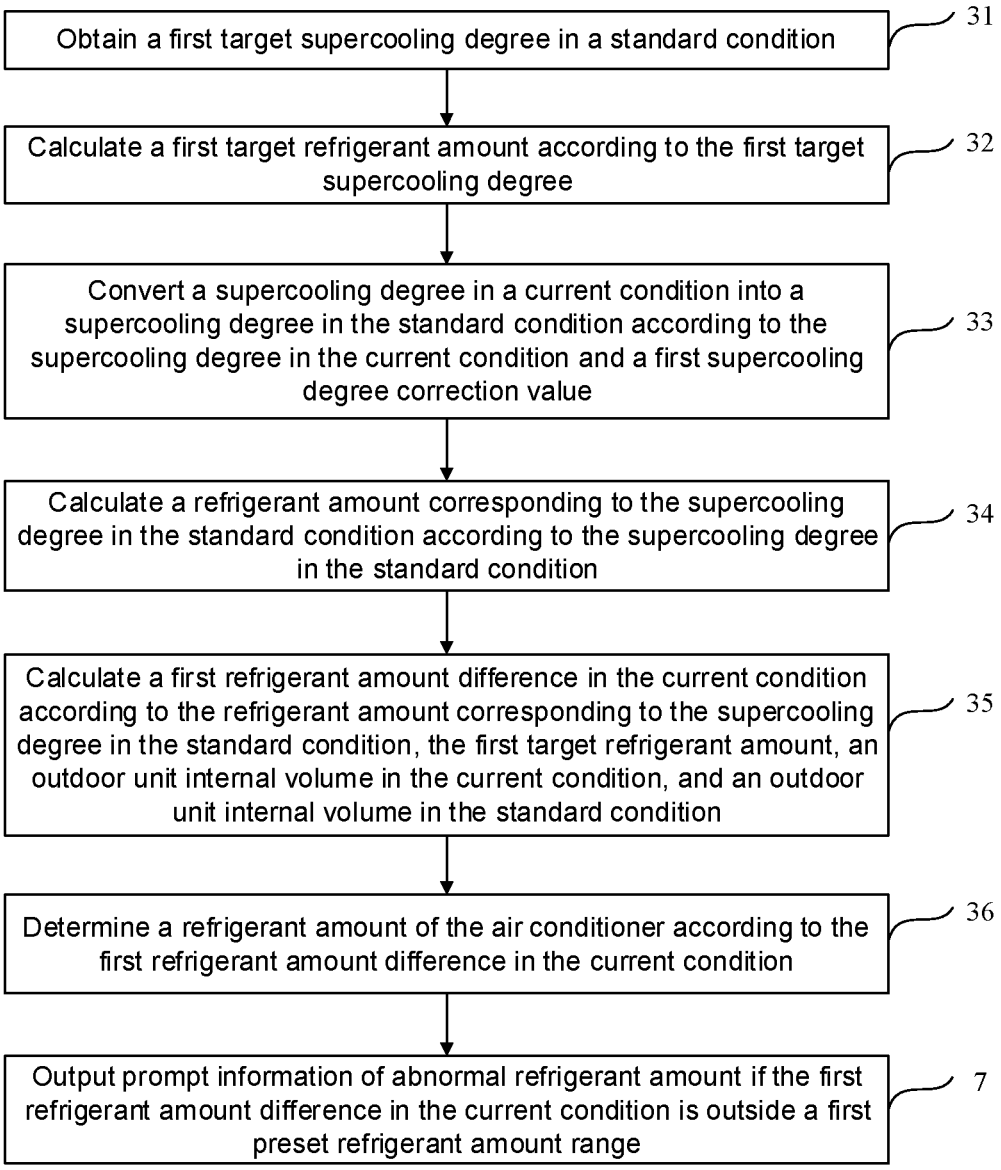
FIG. 5 is yet another flow chart of a control method of an air conditioner, in accordance with some embodiments.

In some embodiments, as shown in FIG. 5, the step 3 includes step 31 to step 36.

In step 31, a first target supercooling degree $SCo_c$ in a standard condition (i.e., the first standard condition) is obtained.

In step 32, a first target refrigerant amount MCo is calculated according to the first target supercooling degree $SCo_c$.

For example, the first target refrigerant amount MCo is calculated through the formula (1).

In step 33, a supercooling degree $SCz_c$ in a current condition is converted into a supercooling degree $SCs_c$ in the standard condition according to the supercooling degree $SCz_c$ in the current condition and a first supercooling degree correction value $SCo1_c$.

In step 34, a refrigerant amount MCs corresponding to the supercooling degree $SCs_c$ in the standard condition is calculated according to the supercooling degree $SCs_c$ in the standard condition.

For example, the refrigerant amount MCs corresponding to the supercooling degree $SCs_c$ in the standard condition is calculated through the formula (1).

In step 35, a first refrigerant amount difference ΔMC in the current condition is calculated according to the refrigerant amount MCs corresponding to the supercooling degree $SCs_c$ in the standard condition, the first target refrigerant amount MCo, an outdoor unit internal volume in the current condition, and an outdoor unit internal volume in the standard condition.

For example, the first refrigerant amount difference ΔMC in the current condition is calculated through the formula (6).

In step 36, the refrigerant amount of the air conditioner is determined according to the first refrigerant amount difference ΔMC in the current condition.

Figure 6:
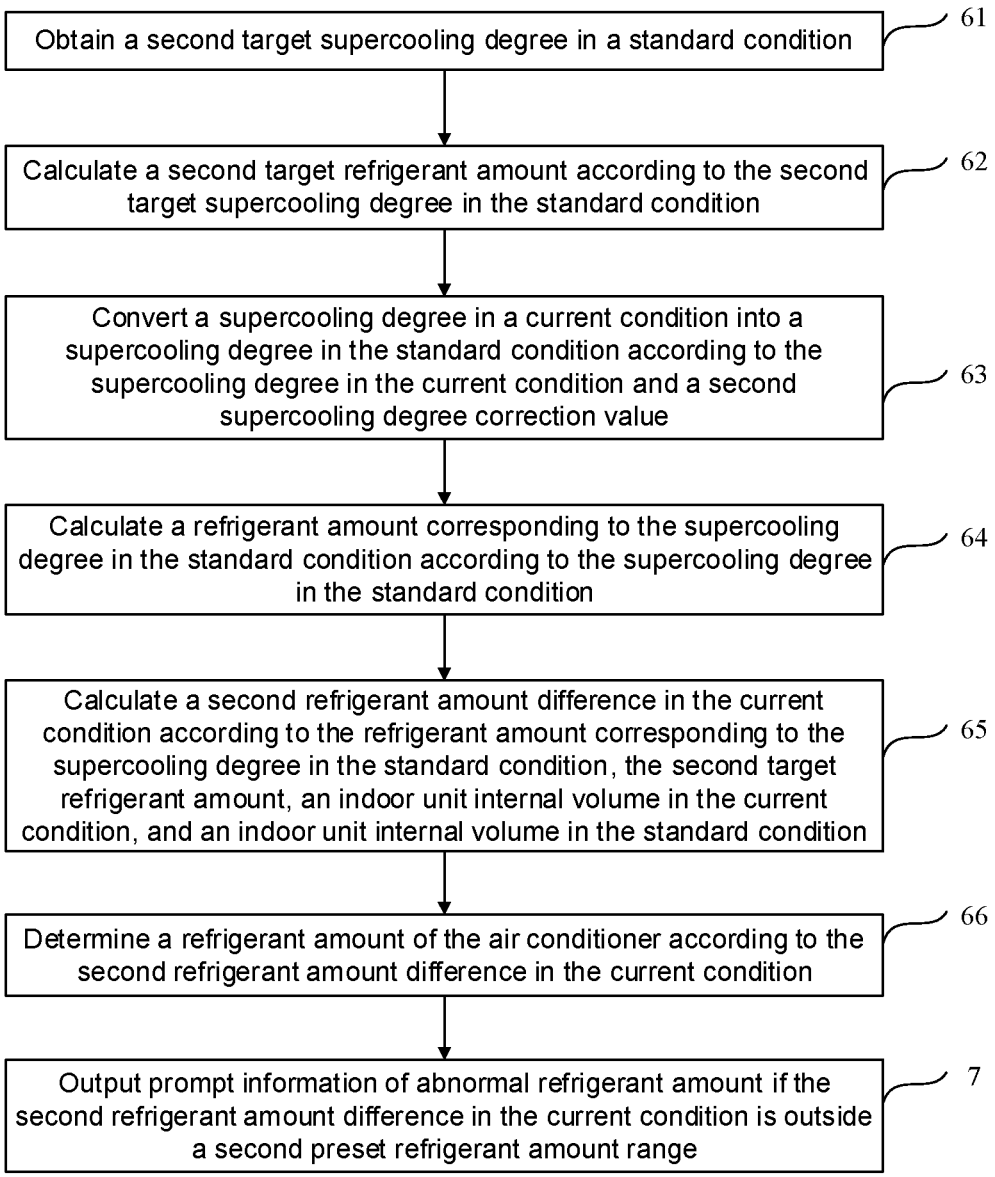
FIG. 6 is yet another flow chart of a control method of an air conditioner, in accordance with some embodiments.

In some embodiments, as shown in FIG. 6, the step 6 includes step 61 to step 66.

In step 61, a second target supercooling degree $SCo_h$ in the standard condition (i.e., the second standard condition) is obtained.

In step 62, a second target refrigerant amount MHo is calculated according to the second target supercooling degree $SCo_h$ in the standard condition.

For example, the second target refrigerant amount MHo is calculated through the formula (7).

In step 63, a supercooling degree $SCz_h$ in the current condition is converted into a supercooling degree $SCs_h$ in the standard condition according to the supercooling degree $SCz_h$ in the current condition and a second supercooling degree correction value $SCo1_h$.

For example, the supercooling degree $SCs_h$ in the standard condition is calculated through the formula (10).

In step 64, a refrigerant amount MHs corresponding to the supercooling degree $SCs_h$ in the standard condition is calculated according to the supercooling degree $SCs_h$ in the standard condition.

For example, the refrigerant amount MHs corresponding to the supercooling degree $SCs_h$ in the standard condition is calculated through the formula (7).

In step 65, a second refrigerant amount difference ΔMH in the current condition is calculated according to the refrigerant amount MHs corresponding to the supercooling degree $SCs_h$ in the standard condition, the second target refrigerant amount MHo, an indoor unit internal volume in the current condition, and an indoor unit internal volume in the standard condition.

For example, the second refrigerant amount difference ΔMH in the current condition is calculated through the formula (13).

In step 66, the refrigerant amount of the air conditioner is determined according to the second refrigerant amount difference ΔMH in the current condition.

In some embodiments, the first supercooling degree correction value $SCo1_c$ is related to the outdoor ambient temperature and is any value within a threshold range.

In some embodiments, the second supercooling degree correction value $SCo1_h$ is obtained according to the formula (11).

In some embodiments, the values of RHa, RHb, and RHc in the formula (11) satisfy that, RHa is any value within an open interval with a lower limit of 2 and an upper limit of 5 (i.e., (2, 5)); RHb is any value within an open interval with a lower limit of 0.1 and an upper limit of 0.5 (i.e., (0.1, 0.5)); and RHc is any value within an open interval with a lower limit of −1 and an upper limit of 0 (i.e., (−1, 0)).

In some embodiments, the step 1 includes: in a case where the outdoor ambient temperature is within a first preset range, the return air temperature of the indoor unit is within a second preset range, and the indoor unit is in a shutdown state, determining that the air conditioner is operating in the cooling mode.

In some embodiments, the step 4 includes: in a case where the outdoor ambient temperature is within a third preset range, the return air temperature of the indoor unit is within a fourth preset range, and the indoor unit is in a shutdown state, determining that the air conditioner is operating in the heating mode.

In some embodiments, the step 2 includes collecting an exhaust temperature of a compressor periodically after the air conditioner operates in the cooling mode for a preset duration; in a case where a difference between two adjacent exhaust temperatures collected is within a first preset temperature range, a first superheat degree of the indoor unit is greater than a first preset value and lasts for a first period T1, and a second superheat degree of the indoor unit is less than a second preset value and lasts for a second period T2, determining that the air conditioner is operating stably in the cooling mode.

In some embodiments, the step 5 includes collecting the exhaust temperature of the compressor periodically after the air conditioner operates in the heating mode for the preset duration; in a case where a difference between two adjacent exhaust temperatures collected is within a second preset temperature range, determining that the air conditioner is operating stably in the heating mode.

In some embodiments, as shown in FIGS. 5 and 6, after the step 36 or the step 66, the method further includes step 7.

In step 7, if one of the following is satisfied, prompt information of abnormal refrigerant amount is outputted: the first refrigerant amount difference ΔMC in the current condition is outside a first preset refrigerant amount range, or the second refrigerant amount difference ΔMH in the current condition is outside a second preset refrigerant amount range.

A person skilled in the art will understand that the scope of disclosure in the present disclosure is not limited to specific embodiments discussed above and may modify and substitute some elements of the embodiments without departing from the spirits of this application. The scope of this application is limited by the appended claims.

What is claimed is:

1. An air conditioner, comprising:

an outdoor unit, the outdoor unit including a compressor;

at least one indoor unit;

a refrigerant circulation loop, the outdoor unit being connected to the at least one indoor unit through the refrigerant circulation loop; and a controller, wherein the controller is configured to:

determine whether the air conditioner is operating in one of a cooling mode and a heating mode according to an outdoor ambient temperature, a return air temperature of the indoor unit, and an operating state of the indoor unit; and the controller is further configured to:

perform a first refrigerant amount determining mode if it is determined that the air conditioner is operating in the cooling mode, and the air conditioner is operating stably in the cooling mode, including:

obtaining a first target supercooling degree in a first standard condition;

converting a supercooling degree in a current condition into a supercooling degree in the first standard condition;

obtaining a first refrigerant amount difference according to the first target supercooling degree, the supercooling degree in the first standard condition, an outdoor unit internal volume in the first standard condition, and an outdoor unit internal volume in the current condition; wherein the first refrigerant amount difference is a first relative refrigerant amount calculated based on the first standard condition in the cooling mode; and determining a refrigerant amount of the air conditioner according to the first refrigerant amount difference;

wherein after the air conditioner operates in the cooling mode for a preset duration, an exhaust temperature of the compressor is periodically collected, and that the air conditioner is operating stably in the cooling mode, includes: a difference between two adjacent exhaust temperatures collected being within a first preset temperature range, a first superheat degree of the indoor unit being greater than a first preset value and lasts for a first period, and a second superheat degree of the indoor unit being less than a second preset value and lasts for a second period;

or, perform a second refrigerant amount determining mode if it is determined that the air conditioner is operating in the heating mode, and the air conditioner is operating stably in the heating mode, including:

obtaining a second target supercooling degree in a second standard condition;

converting a supercooling degree in the current condition into a supercooling degree in the second standard condition;

obtaining a second refrigerant amount difference according to the second target supercooling degree, the supercooling degree in the second standard condition, an indoor unit internal volume in the second standard condition, and an indoor unit internal volume in the current condition; wherein the second refrigerant amount difference is a second relative refrigerant amount calculated based on the second standard condition in the heating mode; and determining the refrigerant amount of the air conditioner according to the second refrigerant amount difference;

wherein after the air conditioner operates in the heating mode for a preset duration, an exhaust temperature of the compressor is periodically collected, and that the air conditioner is operating stably in the heating mode, includes: a difference between two adjacent exhaust temperatures collected being within a second preset temperature range.

2. The air conditioner according to claim 1, wherein the controller is further configured to:

calculate the supercooling degree in the first standard condition according to the supercooling degree in the current condition and a first supercooling degree correction value, in the first refrigerant amount determining mode.

3. The air conditioner according to claim 2, wherein the first supercooling degree correction value is at least related to the outdoor ambient temperature and is any value within a threshold range.

4. The air conditioner according to claim 2, wherein the controller is further configured to:

calculate a first target refrigerant amount according to the first target supercooling degree, in the first refrigerant amount determining mode; wherein the first target refrigerant amount is greater than or equal to 0;

calculate a refrigerant amount corresponding to the supercooling degree in the first standard condition according to the supercooling degree in the first standard condition; wherein the refrigerant amount corresponding to the supercooling degree in the first standard condition is greater than or equal to 0; and calculate the first refrigerant amount difference according to the refrigerant amount corresponding to the supercooling degree in the first standard condition, the first target refrigerant amount, the outdoor unit internal volume in the current condition, and the outdoor unit internal volume in the first standard condition.

5. The air conditioner according to claim 1, wherein the controller is further configured to:

calculate the supercooling degree in the second standard condition according to the supercooling degree in the current condition and a second supercooling degree correction value, in the second refrigerant amount determining mode.

6. The air conditioner according to claim 5, wherein the controller is further configured to:

calculate the second supercooling degree correction value according to a first constant, a second constant, a third constant, the outdoor ambient temperature, and an indoor ambient temperature; wherein the indoor ambient temperature is an average of the return air temperatures of the indoor unit.

7. The air conditioner according to claim 6, wherein the first constant is any value within a first open interval with a lower limit of 2 and an upper limit of 5;

the second constant is any value within a second open interval with a lower limit of 0.1 and an upper limit of 0.5; and the third constant is any value within a third open interval with a lower limit of −1 and an upper limit of 0.

8. The air conditioner according to claim 5, wherein the controller is further configured to:

calculate a second target refrigerant amount according to the second target supercooling degree, in the second refrigerant amount determining mode; wherein the second target refrigerant amount is greater than or equal to 0;

calculate a refrigerant amount corresponding to the supercooling degree in the second standard condition according to the supercooling degree in the second standard condition; wherein the refrigerant amount corresponding to the supercooling degree in the second standard condition is greater than or equal to 0; and calculate the second refrigerant amount difference according to the refrigerant amount corresponding to the supercooling degree in the second standard condition, the second target refrigerant amount, the indoor unit internal volume in the current condition, and the indoor unit internal volume in the second standard condition.

9. The air conditioner according to claim 1, wherein the controller is further configured to:

determine that the air conditioner is operating in the cooling mode if the outdoor ambient temperature is within a first preset range, the return air temperature of the indoor unit is within a second preset range, and the indoor unit is in a shutdown state; and determine that the air conditioner is operating in the heating mode if the outdoor ambient temperature is within a third preset range, the return air temperature of the indoor unit is within a fourth preset range, and the indoor unit is in the shutdown state.

10. The air conditioner according to claim 1, wherein the at least one indoor unit includes a plurality of indoor units;

wherein the first superheat degree of the indoor unit is a minimum value among superheat degrees of the plurality of indoor units; and the second superheat degree of the indoor unit is a maximum value among the superheat degrees of the plurality of indoor units.

11. The air conditioner according to claim 1, wherein the controller satisfies one of following:

that the controller is further configured to output prompt information of abnormal refrigerant amount in a case where the first refrigerant amount difference is outside a first preset refrigerant amount range;

and, that the controller is further configured to output the prompt information of abnormal refrigerant amount in a case where the second refrigerant amount difference is outside a second preset refrigerant amount range.

12. A control method of an air conditioner, wherein the air conditioner includes:

an outdoor unit, the outdoor unit including a compressor;

at least one indoor unit;

a refrigerant circulation loop, the outdoor unit being connected to the at least one indoor unit through the refrigerant circulation loop; and a controller coupled to the outdoor unit, the indoor unit, and the refrigerant circulation loop;

the method comprises:

determining whether the air conditioner is operating in one of a cooling mode and a heating mode according to an outdoor ambient temperature, a return air temperature of the indoor unit, and an operating state of the indoor unit; and the method further comprises:

performing a first refrigerant amount determining mode if it is determined that the air conditioner is operating in the cooling mode, and the air conditioner is operating stably in the cooling mode, the performing the first refrigerant amount determining mode including:

obtaining a first target supercooling degree in a first standard condition;

calculating a first target refrigerant amount according to the first target supercooling degree; wherein the first target refrigerant amount is greater than or equal to 0;

converting a supercooling degree in a current condition into a supercooling degree in the first standard condition according to the supercooling degree in the current condition and a first supercooling degree correction value;

calculating a refrigerant amount corresponding to the supercooling degree in the first standard condition according to the supercooling degree in the first standard condition; wherein the refrigerant amount corresponding to the supercooling degree in the first standard condition is greater than or equal to 0;

calculating a first refrigerant amount difference according to the refrigerant amount corresponding to the supercooling degree in the first standard condition, the first target refrigerant amount, an outdoor unit internal volume in the current condition, and an outdoor unit internal volume in the first standard condition; and determining a refrigerant amount of the air conditioner according to the first refrigerant amount difference;

wherein after the air conditioner operates in the cooling mode for a preset duration, an exhaust temperature of the compressor is periodically collected, and that the air conditioner is operating stably in the cooling mode, includes: a difference between two adjacent exhaust temperatures collected being within a first preset temperature range, a first superheat degree of the indoor unit being greater than a first preset value and lasts for a first period, and a second superheat degree of the indoor unit being less than a second preset value and lasts for a second period;

or, performing a second refrigerant amount determining mode if it is determined that the air conditioner is operating in the heating mode, and the air conditioner is operating stably in the heating mode, the performing the second refrigerant amount determining mode including:

obtaining a second target supercooling degree in a second standard condition;

calculating a second target refrigerant amount according to the second target supercooling degree; wherein the second target refrigerant amount is greater than or equal to 0;

converting a supercooling degree in a current condition into a supercooling degree in the second standard condition according to the supercooling degree in the current condition and a second supercooling degree correction value;

calculating a refrigerant amount corresponding to the supercooling degree in the second standard condition according to the supercooling degree in the second standard condition; wherein the refrigerant amount corresponding to the supercooling degree in the second standard condition is greater than or equal to 0;

calculating a second refrigerant amount difference according to the refrigerant amount corresponding to the supercooling degree in the second standard condition, the second target refrigerant amount, an indoor unit internal volume in the current condition, and an indoor unit internal volume in the second standard condition; and determining the refrigerant amount of the air conditioner according to the second refrigerant amount difference;

wherein after the air conditioner operates in the heating mode for a preset duration, an exhaust temperature of the compressor is periodically collected, and that the air conditioner is operating stably in the heating mode, includes: a difference between two adjacent exhaust temperatures collected being within a second preset temperature range.

13. The method according to claim 12, wherein the first supercooling degree correction value is at least related to the outdoor ambient temperature and is any value within a threshold range.

14. The method according to claim 12, further comprising:

calculating the second supercooling degree correction value according to a first constant, a second constant, a third constant, the outdoor ambient temperature, and an indoor ambient temperature; wherein the indoor ambient temperature is an average of the return air temperatures of the indoor unit.

15. The method according to claim 14, wherein the first constant is any value within a first open interval with a lower limit of 2 and an upper limit of 5;

the second constant is any value within a second open interval with a lower limit of 0.1 and an upper limit of 0.5; and the third constant is any value within a third open interval with a lower limit of −1 and an upper limit of 0.

16. The method according to claim 12, wherein determining whether the air conditioner is operating in one of the cooling mode and the heating mode according to the outdoor ambient temperature, the return air temperature of the indoor unit, and the operating state of the indoor unit includes:

determining that the air conditioner is operating in the cooling mode if the outdoor ambient temperature is within a first preset range, the return air temperature of the indoor unit is within a second preset range, and the indoor unit is in a shutdown state; and determining that the air conditioner is operating in the heating mode if the outdoor ambient temperature is within a third preset range, the return air temperature of the indoor unit is within a fourth preset range, and the indoor unit is in the shutdown state.

17. The method according to claim 12, wherein the at least one indoor unit includes a plurality of indoor units;

wherein the first superheat degree of the indoor unit is a minimum value among superheat degrees of the plurality of indoor units; and the second superheat degree of the indoor unit is a maximum value among the superheat degrees of the plurality of indoor units.

18. The method according to claim 12, further comprising one of following:

outputting prompt information of abnormal refrigerant amount in a case where the first refrigerant amount difference is outside a first preset refrigerant amount range;

and, outputting the prompt information of abnormal refrigerant amount in a case where the second refrigerant amount difference is outside a second preset refrigerant amount range.

* * * * *